United States Patent [19]

Maurer et al.

[11] Patent Number: 4,988,924

[45] Date of Patent: Jan. 29, 1991

[54] CIRCUIT ARRANGEMENT FOR CONTROLLING THE BRIGHTNESS OF A LAMP

[76] Inventors: Ingo Maurer, Kaiserstrasse 47, D-8000 Muenchen 40; Hermann Koivatsch, Lindwurmstr. 207 D-8000 Munchen 2, both of Fed. Rep. of Germany

[21] Appl. No.: 363,888

[22] PCT Filed: Oct. 25, 1988

[86] PCT No.: PCT/EP88/00956

§ 371 Date: Jun. 6, 1989

§ 102(e) Date: Jun. 6, 1989

[87] PCT Pub. No.: WO89/04110

PCT Pub. Date: May 5, 1989

[30] Foreign Application Priority Data

Oct. 26, 1987 [DE] Fed. Rep. of Germany ..... 3736222

[51] Int. Cl.[5] ..... H05B 37/02

[52] U.S. Cl. ..... 315/291; 315/362; 315/219; 323/904

[58] Field of Search ..... 315/291, 362, 219, 307, 315/194; 323/904

[56] References Cited

U.S. PATENT DOCUMENTS 4,168,453 9/1979 Gerhard ..... 315/291
4,250,432 2/1981 Kohler ..... 315/291
4,379,254 4/1983 Hurban ..... 315/307
4,663,570 5/1987 Luchaco ..... 315/219

FOREIGN PATENT DOCUMENTS 2647266 4/1978 Fed. Rep. of Germany .
2822833 12/1978 Fed. Rep. of Germany .
2077011 12/1981 United Kingdom .

OTHER PUBLICATIONS

Funk-Technik 37 (1982), Heft 5, p. 192.

*Primary Examiner*—Eugene R. LaRoche
*Assistant Examiner*—Amir Zarabian
*Attorney, Agent, or Firm*—Fleit, Jacobson, Cohn, Price, Holman & Stern

[57] ABSTRACT

A circuit arrangement is useful for controlling the brightness of a lamp (L) connected to a mains alternating voltage (N) by means of a sensor (SE) arranged on the lamp. The mains alternating voltage (N) is rectified by a rectifier (GL) and supplied to a transformer circuit (P, S) designed as a half-bridge transformer. The primary part (P) of the electronic transformer (P, S) is controlled by a brightness signal (H) which is modified, by a control unit (ST) connected to the sensor (SE), in function of the contact of the sensor (SE). The lamp (L) is connected to the secondary part of the transformer circuit (P, S).

6 Claims, 3 Drawing Sheets

CIRCUIT ARRANGEMENT FOR CONTROLLING THE BRIGHTNESS OF A LAMP

The present invention relates to a circuit arrangement for controlling the brightness of a lamp according to the preamble of claim 1.

It is already known to control the brightness of a lamp in a light connected to a mains alternating voltage by touching an electrically conduCtive part of the light or of the lamp serving as a sensor (German periodical "Funk-Technik" [Radio Technology], Volume 37, Issue No. 5, 1982, page 192). Upon a first short touching of the sensor the lamp is switched on. When the sensor is being touched for a longer time, the brightness of the lamp, if required, can be modified. The lamp is switched off as the sensor is shortly touched a second time. Such known circuit arrangement comprises a lamp which is connected to a mains alternating voltage by means of a triac. A control unit, to which the sensor is connected, supplies a brightness signal to the triac. With the brightness signal the triac is switched on, switched off, or conductively controlled according to the desired brightness of the lamp. The brightness control of the lamp is thereby achieved according to a phase control which is controlled by the momentary value of the brightness signal.

For a low voltage lamp such as e.g. a halogen lamp, such known circuit arrangement is not provided for and not suited, either, because a low voltage source would be required for its operation. Particularly when using a conventional transformer for generating the required low voltage source, such circuit arrangement would require high expenditure and a large volume.

It is therefore the object of this invention to provide a circuit arrangement for controlling the brightness of a lamp, which arrangement is suitable for low voltage lamps and which requires low expenditure and particularly a small volume only.

According to the present invention this object is achieved in a circuit arrangement of the above-described kind by the features recited in the characterizing clause of claim 1.

The circuit arrangement according to the invention has the advantage that, particularly by using the transformer circuit, it is small in size and requires low costs only.

Advantageous further developments of the invention are shown in the claims 1 to 6.

An embodiment of the circuit arrangement according to the invention is described in detail hereinafter, reference being had the accompanying drawing in which:

Figure 1:
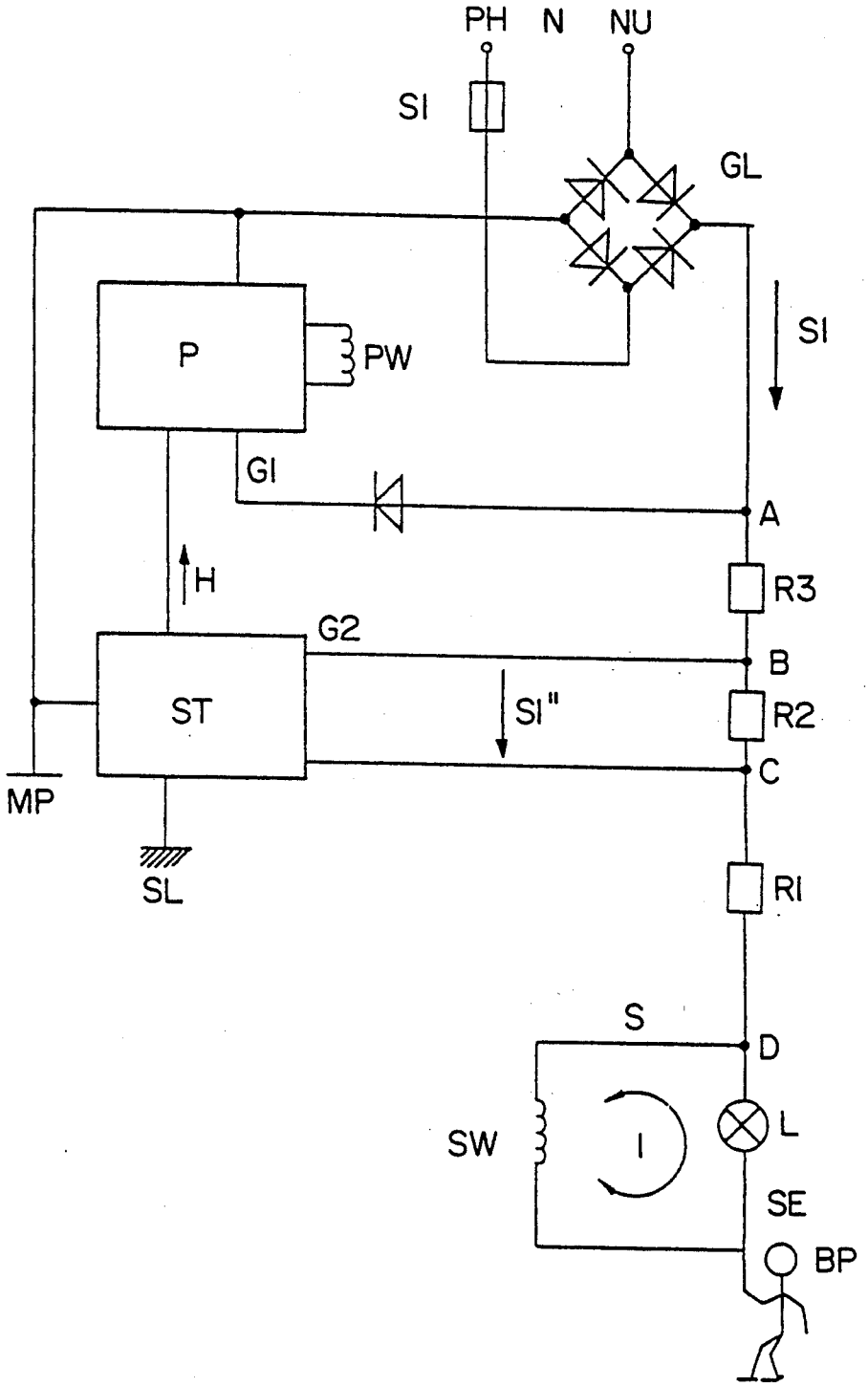
FIG. 1 is a block diagram of the circuit arrangement.

In the circuit arrangement shown in FIG. 1 a mains alternating voltage N of e.g. 220 V is supplied via a fuse SI to a rectifier GL which is designed particularly as a full-wave rectifier. The mains alternating voltage N is supplied via a phase connection PH and a neutral conductor NU. The rectifier GL rectifies the mains alternating voltage N and generates a first direct voltage G1, which is supplied to a transformer circuit which is designed as a half-bridge transformer and comprises a primary section P and a secondary section S. The primary section P has a primary winding PW which is magnetically coupled to the secondary winding SW of the secondary section S. A low voltage lamp L, particularly a halogen lamp, is connected to the secondary winding SW. Said lamp L lightens as soon as an appropriate voltage is induced in the secondary winding SW and a current I flows through the lamp.

The primary section P is controlled by a control unit ST, to which a sensor SE is connected. Such a control unit ST is commonly known and commercially available for example under the trade name S 576A (Siemens). The sensor SE is preferably connected with the secondary section S and arranged on the light. As an operating person BP touches the sensor SE, a small current S1 for example of 200 $\mu$A flows from the rectifier GL via the resistors R3, R2, R1, the lamp L and the operating person BP. A voltage drop at the resistor R2 is evaluated by a comparator in the control unit ST. The control unit ST generates a brightness signal H, by which the primary section P is switched on and controlled. When the operating person BP only shortly touches the sensor, the lamp L is switched on. When the contact between the operating person and the sensor is of longer duration, the momentary value of the brightness signal H is modified by the control unit ST, and thereby the brightness of the lamp L is modified by means of the primary section P according to a phase control, so that the brightness of the lamp L is defined by the duration of the touching. When the sensor SE is shortly touched a second time, the lamp can be switched off.

The voltage supply to the control unit ST is effected by a second direct voltage G2 of for example 15 V, which is generated from the pulsating direct voltage G1 which is supplied to the control unit ST via the resistor R3 connected between the points A and B. The sensor SE is controlled via a further resistor R2 connected between the point B and a point C and the resistor R1 connected between the point C and a point D. The control unit ST is connected on one hand to a mass point MP, to which also the rectifier GL and the primary section P are connected, and on the other hand the control unit ST is connected also to a protective conductor SL of the mains alternating voltage N or attached to the neutral conductor NU. The protective conductor SL or the neutral conductor NU serve as a reference voltage for the synchronization of the control unit ST by the zero-axis crossings of the mains alternating voltage N. In case of synchronization by means of the protective conductor SL it is irrelevant how the mains plug is being plugged-in. However, it is required that a protective conductor SL be available, something that is not the case in some countries. In case of synchronization by means of the neutral conductor NU, however, it is important that the mains plug be plugged-in in the correct direction to ensure that the control unit ST is connected to the neutral conductor NU, but not to the phase connection PH.

Figure 2:
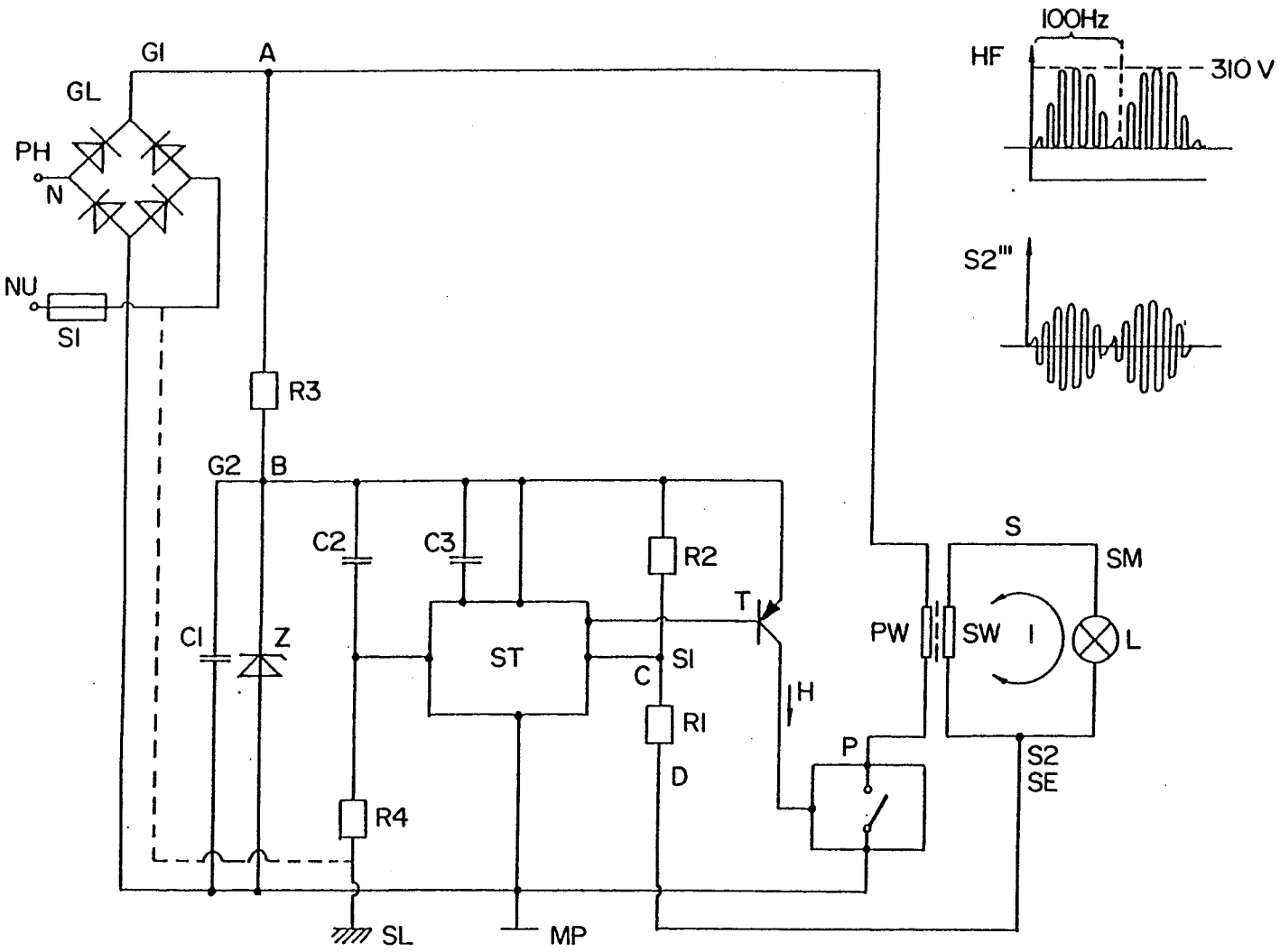
FIG. 2 is a simplified circuit diagram of the circuit arrangement.
Figure 3:
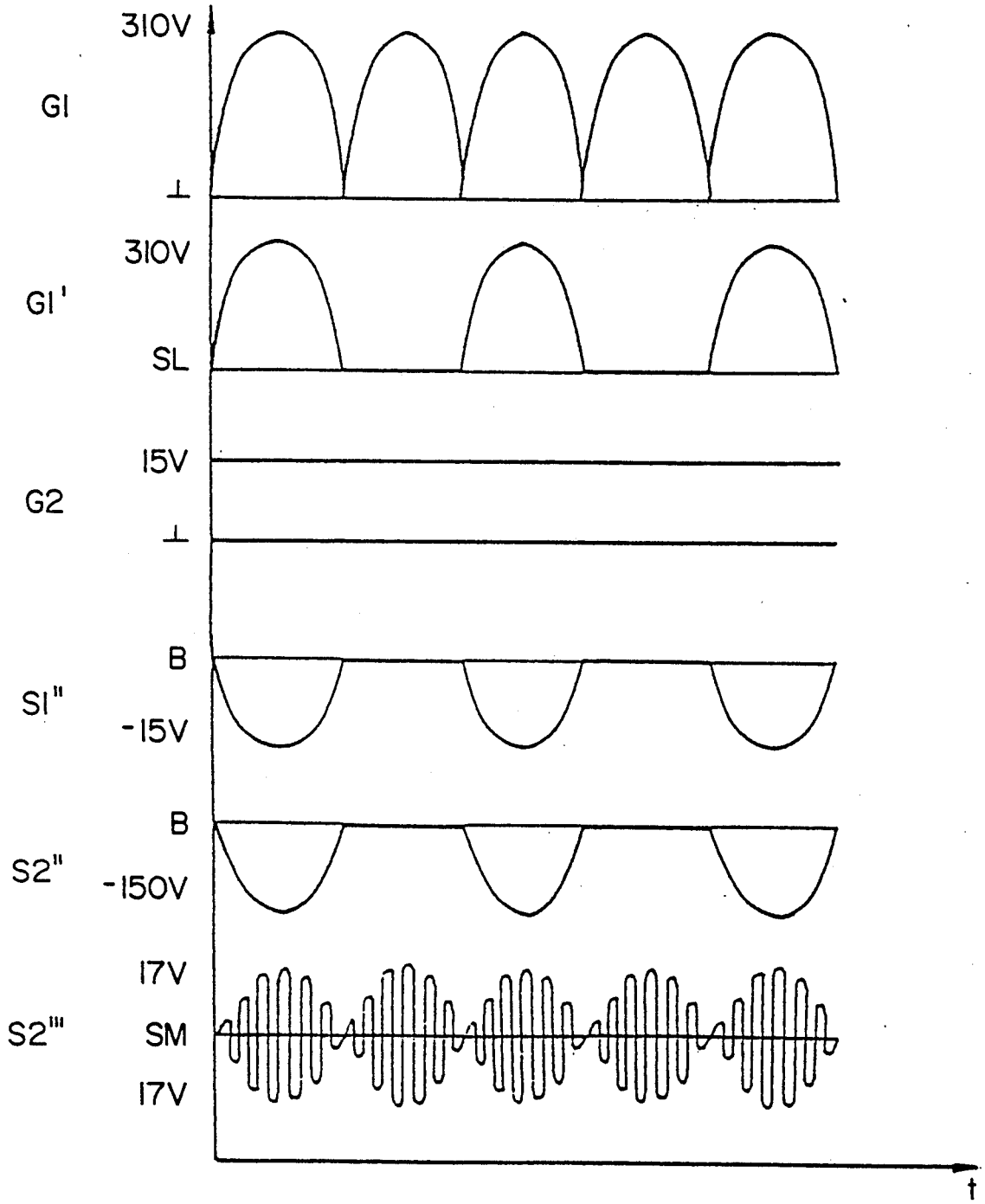
FIG. 3 shows time diagrams of signals at different locations of the circuit arrangement.

Further details of the circuit arrangement are described hereinafter with reference to the circuit diagram shown in FIG. 2 and to the time diagrams shown in FIG. 3 in which the time t is shown in the X-axis and the momentary values of signals at various points of the circuit arrangement of FIG. 2 are shown in the Y-axis.

In the circuit arrangement shown in FIG. 2, the rectifier GL generates the pulsating direct voltage G1 from the mains alternating voltage N which is supplied via the fuse SI. At a point A the direct voltage G1 has a peak value of about 310 V referred to the mass point MP. This pulsating direct voltage G1 at the point A is shown on top of FIG. 3. With reference to the ground or to the protective conductor SL there is a pulsating direct voltage G1' which is also shown in FIG. 3. Such direct voltage G1', however, contains only half-waves of the mains alternating voltage N. The direct voltage G1 is being applied on the one hand to the primary section P and on the other hand—via the resistor R3—to a Zener diode Z which generates the direct voltage G2 at point B as an operating voltage for the control unit ST. A filter capacitor C1 is connected in parallel to the Zener diode Z. As shown in FIG. 3, the direct voltage G2 at point B, referred to the mass point MP, is a smoothened direct voltage of 15 V for example.

The transformer circuit is designed in a known manner as a half-bridge transformer which generates in the primary section P the high-frequency oscillation HF at a frequency of e.g. 40 kHz, and the high-frequency oscillation is modulated by the pulsating direct voltage G1. Said oscillation HF is shown in FIG. 2. It generates in the secondary winding SW at point D a high-frequency oscillation S2''' (shown in FIGS. 2 and 3) with an amplitude of e.g. +−17 V referred to a secondary mass point SM. Said oscillation S2''' causes a current I to flow through the lamp L which then lightens according to the desired brightness.

The lamp is switched on as an operating person touches the sensor SE. As also shown in FIG. 3, the point D then exhibits voltage curve S2'' with an amplitude of about −150 V referred to the direct voltage G2 at point B. By means of the voltage divider from the resistors R1 and R2 there is generated, at point C, a voltage S1'' with an amplitude of about −15 V referred to the direct voltage G2.

As the voltage S1'' occurs, the control unit ST supplies to the transistor T a signal which controls the latter to conduction and generates the brightness signal H in order to switch the electronic transformer on, which is schematically shown by a switch in the primary section P. Thus, the high-frequency oscillation HS is generated in the primary section P, and in the secondary section S the current I flows for operating the lamp L.

For obtaining the synchronization signal for the control unit ST from the zero-axis crossings there is provided the protective conductor SL or the neutral conductor NU, as shown by the dotted line, of the mains alternating voltage N. The protective conductor SL or the neutral conductor NU respectively is connected to the control unit ST via a resistor R4. Furthermore, the point of connection of the resistor R4 to the control unit ST is being applied to the direct voltage G2 via a capacitor C2. Also, the control unit ST is connected to the direct voltage G2 via a capacitor C3 which removes radio-frequency interferences. Said capacitor C3 defines the internal time basis of the control unit ST.

Subsequent to being switched on, the lamp L burns at a given brightness. If the operating person BP touches the sensor SE for a longer period of time, the momentary value of the brightness signal H changes, and thus according to a phase control the brightness of the lamp L is controlled. The lamp L is switched off by shortly touching the sensor once again. Then, the transformer T is blocked, and the transformer circuit is switched off again.

I claim:

1. Circuit arrangement for controlling the brightness of a lamp in a light connected to a mains alternating voltage, in which circuit both the switching-on of the lamp and the control of the brightness are effected by touching a sensor, and in which there is provided a control unit, to which the sensor is connected and which supplies a brightness signal associated to the brightness of the lamp, characterized in that a rectifier (GL) is provided which is connected to the mains alternating voltage (N), that a transformer circuit (P, S) operating at high-frequency is connected to the rectified mains alternating voltage (G1), the brightness signal (H) being applied to the primary section (P) of said transformer circuit (P, S) controlled by the control unit (ST), and the lamp (L) which is designed as low voltage lamp as well as the sensor (SE) being connected to the secondary section (S) of said transformer circuit.

2. Circuit arrangement according to claim 1, characterized in that the high-frequency oscillation (HF) generated in the primary section (P) is modulated according to the rectified mains alternating voltage (G1).

3. Circuit arrangement according to claim 1, characterized in that the sensor (SE) is connected to the control unit (ST) via a high-ohmic resistance (R1).

4. Circuit arrangement according to claim 1, characterized in that the control unit (ST) is connected to a protective conductor (SL) or to the neutral conductor (NU) of the mains alternating voltage (UN).

5. Circuit arrangement according to claim 1, characterized in that the operating voltage (G2) of the control unit (ST) is generated from the rectified mains alternating voltage (G1) by means of a resistor (R3), a Zener diode (Z) and a capacitor (C) connected in parallel to the latter.

6. Circuit arrangement according to claim 1, characterized in that the rectifier (GL) is designed as a full-wave rectifier.

* * * * *